US011885142B2

(12) United States Patent
Garcia

(10) Patent No.: US 11,885,142 B2
(45) Date of Patent: Jan. 30, 2024

(54) STAIR AND WALKWAY SYSTEM AND METHOD

(71) Applicant: WIFCO Steel Products, Inc., Hutchinson, KS (US)

(72) Inventor: Matthew Garcia, Hutchinson, KS (US)

(73) Assignee: WIFCO Steel Products, Inc., Hutchinson, KS (US)

( * ) Notice: Subject to any disclaimer, the term of this patent is extended or adjusted under 35 U.S.C. 154(b) by 502 days.

(21) Appl. No.: 16/848,047

(22) Filed: Apr. 14, 2020

(65) Prior Publication Data

US 2020/0340259 A1 Oct. 29, 2020

Related U.S. Application Data

(60) Provisional application No. 62/871,379, filed on Jul. 8, 2019, provisional application No. 62/839,055, filed on Apr. 26, 2019.

(51) Int. Cl.
*E04G 5/10* (2006.01)
*E04G 1/15* (2006.01)
(Continued)

(52) U.S. Cl.
CPC ..... *E04G 1/362* (2013.01); *E04G 1/08* (2013.01); *E04G 1/15* (2013.01); *E04G 1/152* (2013.01); *E04G 1/365* (2013.01); *E04G 5/04* (2013.01); *E04G 5/061* (2013.01); *E04G 5/08* (2013.01); *E04G 5/10* (2013.01); *E04G 5/14* (2013.01); *E04G 5/16* (2013.01); *E04G 7/02* (2013.01); *E04G 7/28* (2013.01)

(58) Field of Classification Search
CPC .. E04G 1/362; E04G 1/08; E04G 1/15; E04G 1/152; E04G 1/365; E04G 1/34; E04G 5/04; E04G 5/08; E04G 5/10; E04G 5/14; E04G 5/16; E04G 7/02; E04G 7/28; E06C 7/16; E06C 7/081; E06C 1/39; E06C 1/18; E04F 11/02; E04F 11/112; E04F 15/02464; E04F 1/003; E04F 1/18; E04C 3/02; E04C 3/04; E04C 3/11; E04C 3/083; E04C 2003/0413; E04C 2003/0491; E01D 12/00; E01D 19/00; E01D 19/125; E01D 19/12
See application file for complete search history.

(56) References Cited

U.S. PATENT DOCUMENTS 3,889,779 A * 6/1975 Kummerlin ..... E04G 1/152 52/632
3,994,036 A * 11/1976 Fisher ..... E04G 3/30 182/222
(Continued)

OTHER PUBLICATIONS

"Truss." Merriam-Webster.com. 2023. https://merriam-webster.com (Apr. 13, 2023).*

*Primary Examiner* — Jessica L Laux
*Assistant Examiner* — Kathleen M. McFarland
(74) *Attorney, Agent, or Firm* — Avek IP, LLC

(57) ABSTRACT

Disclosed is an arrangement including a staircase as well as walkway systems. The staircase includes a transitional member, and the walkways incorporate grate supports in order to facilitate the connection to adjacent structures. The arrangement also utilizes angled members which are configured with a reinforced flange existing in a dimension that has higher load requirements than the other flange. A novel step configuration is also disclosed.

16 Claims, 18 Drawing Sheets

(51) Int. Cl.

| | |
|---|---|
| ***E04G 5/16*** | (2006.01) |
| ***E04G 5/08*** | (2006.01) |
| ***E04G 5/04*** | (2006.01) |
| ***E04G 7/28*** | (2006.01) |
| ***E04G 5/14*** | (2006.01) |
| ***E04G 1/36*** | (2006.01) |
| ***E04G 1/08*** | (2006.01) |
| ***E04G 5/06*** | (2006.01) |
| ***E04G 7/02*** | (2006.01) |

(56) References Cited

U.S. PATENT DOCUMENTS 4,004,652 A * 1/1977 Laboy-Alvarado ..... E06C 1/39 182/1
4,042,064 A * 8/1977 Lobb ..... E01F 1/00 182/115
4,180,343 A * 12/1979 Finlay ..... E04F 19/10 403/387
4,362,422 A * 12/1982 Zinkann ..... F16B 2/12 403/387
4,620,612 A * 11/1986 Enoki ..... E04G 3/30 182/113
4,904,105 A * 2/1990 Myers ..... E04C 2/428 403/387
5,579,866 A * 12/1996 Rowell ..... E04G 3/30 182/152
5,653,459 A * 8/1997 Murphy ..... B60R 3/007 280/166
6,085,867 A * 7/2000 Daniel, III ..... E04F 11/112 182/115
6,092,626 A * 7/2000 Young ..... E04G 5/00 182/118
D466,617 S * 12/2002 Leemans ..... D25/62
6,763,912 B2 * 7/2004 Robinson ..... E06C 1/39 182/115
8,769,752 B2 7/2014 Ade et al.
10,017,988 B2 * 7/2018 Smith ..... E06C 1/393
10,358,871 B2 * 7/2019 Honeycutt ..... E04G 1/15
10,526,796 B1 * 1/2020 Way ..... B63B 35/34
10,640,983 B2 * 5/2020 Honeycutt ..... E04G 27/00
D890,957 S * 7/2020 Kuka ..... D25/63
2002/0153201 A1 * 10/2002 Warford ..... E06C 1/39 182/115
2004/0050010 A1 * 3/2004 Fortier ..... E04B 1/003 52/650.3
2008/0251323 A1 * 10/2008 Schworer ..... E04G 1/152 182/223
2010/0294593 A1 * 11/2010 Gordon ..... E04F 11/02 182/115
2012/0073902 A1 * 3/2012 Honeycutt ..... E04G 1/15 182/113
2013/0084133 A1 * 4/2013 Ade ..... E04G 1/362 404/35
2014/0151153 A1 * 6/2014 Mork ..... B66F 3/08 254/98
2014/0318891 A1 * 10/2014 Crothers ..... E04F 11/1861 182/113
2014/0367195 A1 * 12/2014 Melton ..... E06C 1/39 182/115
2016/0115697 A1 * 4/2016 Shaw ..... E04G 7/303 248/317
2016/0237702 A1 * 8/2016 Micklan ..... E04G 3/243
2017/0275888 A1 * 9/2017 Honeycutt ..... E04F 11/025
2017/0292349 A1 * 10/2017 Toma ..... E04G 1/24
2018/0119435 A1 * 5/2018 Jablonski ..... E04G 5/08
2018/0135316 A1 * 5/2018 Apostolopoulos ..... E04G 5/165
2018/0223548 A1 * 8/2018 Brownmiller ..... E04G 5/16
2019/0010714 A1 * 1/2019 Oowaku ..... E04G 3/30
2019/0017281 A1 * 1/2019 Luna ..... E04G 5/10
2019/0106273 A1 * 4/2019 Hess ..... B65D 88/28
2019/0177987 A1 * 6/2019 Neubauer ..... E04G 7/34
2019/0352920 A1 * 11/2019 Salyer ..... E04G 5/007
2019/0352921 A1 * 11/2019 Takemoto ..... B32B 15/20
2019/0360219 A1 * 11/2019 O'Keefe ..... E04G 3/28
2020/0056384 A1 * 2/2020 Curtis ..... E04G 5/08
2020/0224437 A1 * 7/2020 Curtis ..... E04G 7/34
2020/0270107 A1 * 8/2020 Hokanson ..... E04G 1/18
2020/0299978 A1 * 9/2020 Haeberle ..... E04G 5/14
2020/0347618 A1 * 11/2020 Behrbohm ..... E04G 7/28
2021/0095483 A1 * 4/2021 Villarreal, III ..... B64C 1/10
2021/0123249 A1 * 4/2021 Behrbohm ..... E04G 7/307
2021/0198907 A1 * 7/2021 Black ..... E04G 5/141
2021/0293028 A1 * 9/2021 Owen ..... F16B 7/187
2022/0018141 A1 * 1/2022 Morales ..... E04G 1/17
2022/0042304 A1 * 2/2022 Scrafford ..... E04B 5/14

* cited by examiner

STAIR AND WALKWAY SYSTEM AND METHOD

RELATED APPLICATIONS

This application claims the benefit of both U.S. Provisional Patent Application Nos. 62/839,055 filed Apr. 26, 2019 and 62/871,379 filed Jul. 8, 2019, the entire contents of both which are herein incorporated by reference.

BACKGROUND

1. Technical Field

This disclosure relates to the field of providing access to elevated areas proximate a structure. More specifically, the disclosure relates to stair and walkway systems and methods.

2. Discussion of Related Art

The oil and gas industry often makes use of very large tanks for storing preprocessed crude, and sometimes other substances. In order to provide access to the top of these tanks for inspection or other purposes, it has been known to use stairs and platforms. The tanks are often installed proximate to one another. When this is the case, it is known to use a walkway (also known as a "platform") to allow a worker to examine both tanks while only climbing up and down the stairs once.

One example showing such a system can be seen in U.S. Pat. No. 8,769,752 issued to Ade et al. which shows this sort of arrangement in a collapsible configuration.

SUMMARY

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages will be apparent from the following detailed description of the embodiments and the accompanying drawing figures.

Both a walkway, and an accompanying staircase are disclosed. More specifically, support systems for each are disclosed as well as other design specifics. For example, in embodiments, a system for supporting a walkway includes a raised elongated walkway platform that has first and second ends. It is supported at both ends by first and a second supporting members, respectively. Each supporting member suspends the platform above a truss arrangement, each supporting member further enables securement into structures adjacent the first and second ends. In embodiments the system has at least one intermediate platform supporting member located underneath the platform and at a location between the first and second platform supporting members. The intermediate platform supporting member can be substantially identical to the first and second platform supporting members. In embodiments, multiple intermediate platform supporting members can be used in the design, and the truss arrangement is located underneath the platform where the truss includes a plurality of strut bars, and each strut bar is angled from a fixation point on a lower portion of each intermediate platform supporting member, and angles to a fixation point on an opposite side of an adjacent intermediate member. The strut bars can form a zigzag between the plurality of intermediate platform supporting members in embodiments.

In still further embodiments, a plurality of spaced-apart posts laterally lining both sides of the platform, each post supporting a top rail, and being secured in a receiving area defined at the lateral margins of each of the first and second platform supporting members. The platform can be a grating having a plurality of longitudinally-extending parallel bars, and a plurality of longitudinally-spaced cross supports, the cross supports connecting the parallel bars. In still further embodiments, the grating is secured atop an upper shelf, the upper shelf extending from each of the first and second platform supporting members inward and supporting each of the first and second platform ends from below, and openings existing in the grating between the parallel bars and cross members receive fasteners also received through corresponding apertures formed in the top shelf, the bolts used to clamp down saddle members onto the parallel bars to secure each of the first and second platform ends atop the upper shelves of each of the first and second platform supporting members.

In embodiments, the truss arrangement is supported by a lower shelf extending out below the upper shelf, the lower shelf supporting the truss arrangement underneath the platform.

In terms of connection to the walkway, the support member can have a mounting portion configured to mount the elongated platform to the adjacent walkway structure and an upper forwardly-extending shelf which is used to secure the platform to the support member. A lower outwardly-extending shelf can be configured to support the truss arrangement underneath the platform. The mounting portion, in embodiments, can be substantially flat. Further, the substantially flat mounting portion can have mounting holes formed therethrough to receive fasteners to secure a back of the support member to the adjacent structure.

In embodiments, a plurality of holes can be formed through the upper shelf, each hole in the plurality being configured to receive a bolt which also passes through the one end of the platform. In embodiments the platform is a grate, and the plurality of holes in the upper shelf are each aligned with a specific gap in the grate, thus securing the one end of the platform. The lower shelf of the member can include at least one hole configured to receive a bolt which passes through an aperture on a connecting end of one truss member in the plurality. In embodiments, the lower shelf includes a first hole spaced apart from a second hole, the first hole configured to receive a bolt which passes through an end of a first optional angled truss member, the second hole being alternatively useable for the purpose of securing the lower shelf to an alternative second optional truss member which is, when installed, at an angle different than the angle relative to the supporting member.

Also disclosed is a technique of reinforcing key dimensions in the structure. More specifically, a longitudinally-extending angled member can be used for incorporation into a load-bearing structure where the angled member has a first flange; a second flange; and the angled member has an intended structural incorporation such that the first flange is in a first dimension and the second flange is in a second dimension and the load requirements in the first dimension are higher than the load requirements in the second dimension. In this situation, a reinforcing member can be added to the flange in the first dimension to compensate for the different load requirements. The angled member can be a vertical, horizontal, or really have any orientation. In some embodiments, the angled member is incorporated into a walkway structure, and in others, it can be incorporated into a staircase. A metal staircase system is also disclosed. In embodiments, the system includes a plurality of steps, each step in the plurality including downwardly extending sidewalls, and downwardly extending front and back walls, a transition member including a first plurality of fastening enabling structures configured to allow for the attachment of the staircase to an adjacent structure at a top of the staircase; a second plurality of holes in the transition member, the second plurality of holes configured to mate with a corresponding set of holes in the back wall of a top step of the plurality of steps. The plurality of steps can be secured between: opposing angled upper step frame members each having an inner flange which is fixed to a forward location of the side walls for each step; and opposing angled lower step frame members each having an inner flange which is fixed to a rearward location of the sidewalls for each step. The opposing angled upper step frame members and opposing angled lower step frame members can also structurally support a plurality of vertical and horizontal truss members, the vertical and horizontal truss members serving to support railings on each side of the staircase. Each of the horizontal and truss members can have first and second flanges which form an angled cross-sectional shape. Each horizontal truss member can be incorporated into the stairway such that the first flange is in a first dimension and the second flange is in a second dimension, the second flange having higher load requirements than in the first dimension; and a reinforcing member fixed along the length of the second flange for the purpose of providing increased support in the second dimension. The reinforced second flanges for each horizontal truss member can be substantially parallel with the plurality of steps. In embodiments, triangular spacers can be fixed between each of the opposing angled lower step frame members and the opposing angled upper step frame members.

In embodiments, a plurality of steps can be added to the staircase system where each step has a substantially flat upper surface, and a plurality of slots. In some versions, the slots run in the direction of the stairway, and in some versions the slots are melded together at a middle portion of each slot to form a front and back slot openings. In some embodiments, the slots are raised up from a substantially flat upper surface of each step in the plurality, and in others a plurality of raised apertures are included.

The adjacent structure to which the staircase is attached can be a walkway that is at least partially supported by a grate support, the grate support having holes configured to match up with reciprocating holes in the transition member, allowing for the passage of bolts therethrough enabling the securement of the transition member to the grate support.

Also disclosed is a step design. More specifically, in embodiments, the step has a front wall, a back wall, and a pair of side walls each bent down from a substantially flat body. The step can also have a plurality of slots or apertures. The middle portion of each slot can melded together, or not. In some versions, the step includes both slots and apertures, and the slots and apertures are truncated protuberances. In versions, the back wall of the step includes apertures configured to enable the securement of the step to an adjacent structure to support the staircase. The side walls can include aperture pairs designed to secure the step in a substantially horizontal position between upper and lower opposing angled frame member pairs.

Also disclosed is a staircase angled member adapted to meet load bearing requirements. More specifically, embodiments include a first flange; a second flange; and the angled member is incorporated into the staircase such that the first flange is in a first dimension and the second flange is in a second dimension, the first dimension encountering disproportionately increased loads relative to the second dimension upon utilization by users of the stairs; and a reinforcing member is fixed to the first flange to counter the increased load requirements in the first dimension. In embodiments the angled member is a horizontal member which is incorporated into a metal staircase.

BRIEF DESCRIPTION OF THE DRAWINGS

The foregoing and other features and advantages will be apparent from the more particular description of preferred embodiments, as illustrated in the accompanying drawings, in which like reference characters refer to the same parts throughout the different views. The drawings are not necessarily to scale, emphasis instead being placed upon illustrating the principles of the preferred embodiments. In the drawings, the sizes and thicknesses of layers, regions, objects and features may be exaggerated for clarity.

DETAILED DESCRIPTION

The following detailed description references the accompanying drawings that illustrate specific embodiments in which the invention can be practiced. The embodiments are intended to describe aspects of the invention in sufficient detail to enable those skilled in the art to practice the invention. Other embodiments can be utilized and changes can be made without departing from the scope of the invention. The following detailed description is, therefore, not to be taken in a limiting sense. The scope of the invention is defined only by the appended claims, along with the full scope of equivalents to which such claims are entitled.

In this description, references to "one embodiment," "an embodiment", "a version", or "embodiments" mean that the feature or features being referred to are included in at least one embodiment of the technology. Separate references to "one embodiment," "an embodiment," or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the technology can include a variety of combinations and/or integrations of the embodiments described herein.

Figure 1A:
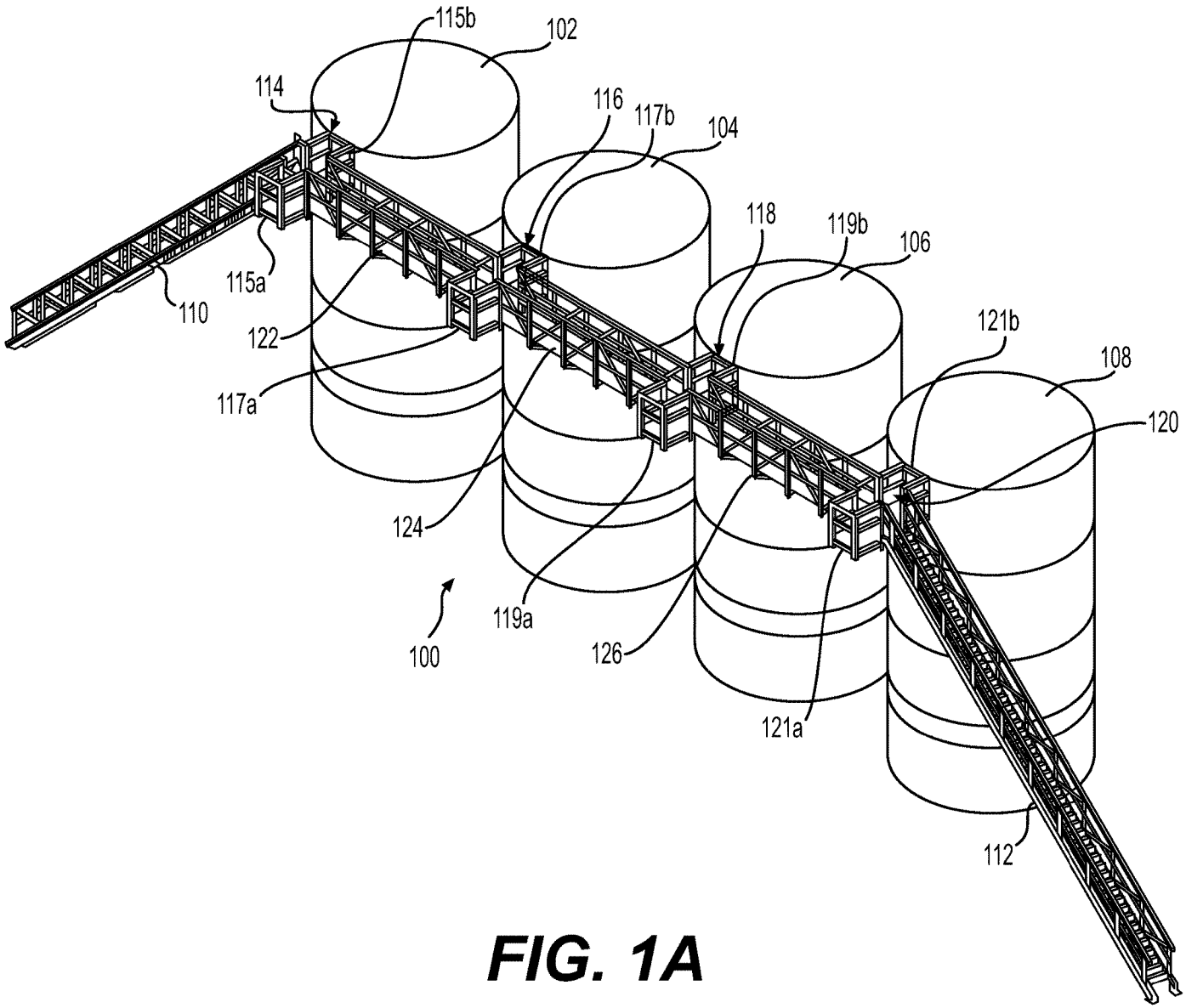
FIG. 1A shows a perspective view of an embodiment of the system.
Figure 1B:
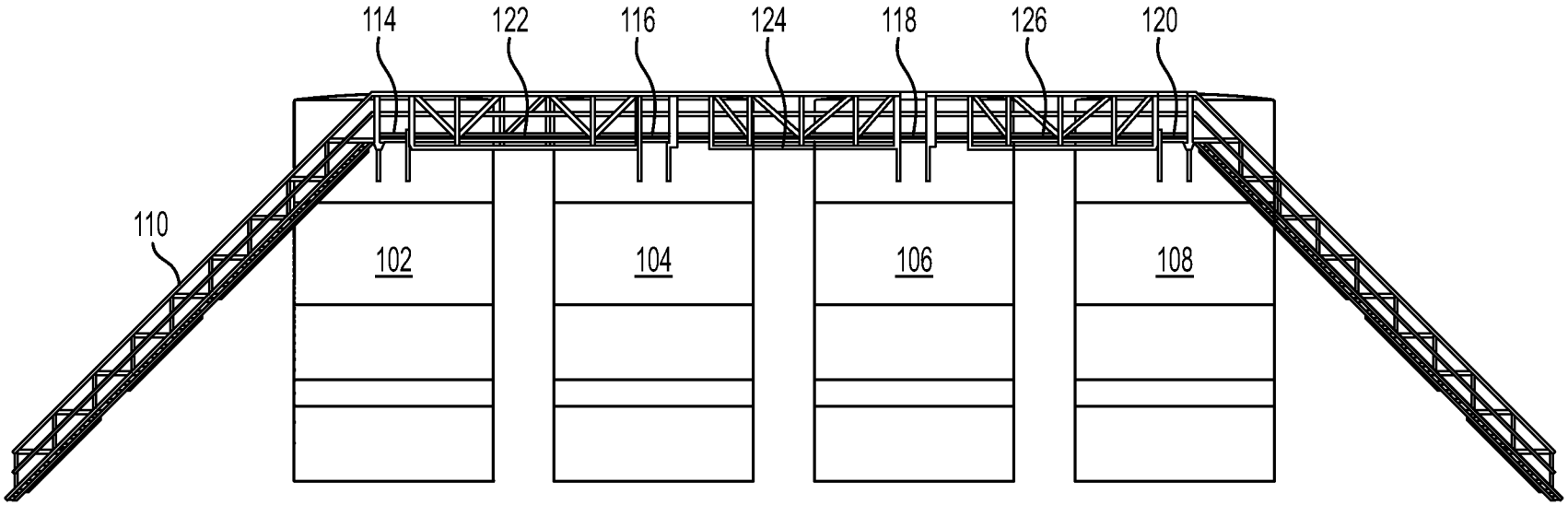
FIG. 1B shows a front view of the system of FIG. 1A.

Disclosed is a walkway system including stairs which is configured for installation proximate structures, e.g., tanks. FIG. 1A shows an embodiment for a system environment. FIG. 1B shows side view of the embodiment depicted in FIG. 1A. The embodiment includes a walkway system 100 providing access to structures 102, 104, 106, and 108 (e.g., petroleum tanks). It should be recognized that a substantially identical row of tanks (not shown) would appear in front of the walkway system 100, but have been removed to expose the system 110 more clearly. System 100 includes first and second staircases 110 and 112. The top of each of staircases 110 and 112 are connected to walkway ends. Each of four cross-access pairs 114, 116, 118, and 120 are included at likely access locations (e.g., for tank inspections, etc.) Each cross-access pair includes front and back pairs. For example, pair 114 includes a front portion 115*a* and a back portion 115*b*. Pair 116 includes a front portion 117*a* and a back portion 117*b*. Pair 118 includes a front portion 119*a* and a back portion 119*b*. Pair 120 includes front portion 121*a* and a back portion 121*b*. Each of back portions 115*b*, 117*b*, 119*b*, and 121*b* are secured to each of tanks 102, 104, 106, and 108, respectively. Similarly, front portions 115*a*, 117*a*, 119*a*, and 121*a* are secured to tanks existing in front of these portions (again, these tanks have been removed for purposes of clarity). Each of the cross-access sets effectively bridge each of the front row of tanks (not shown) with each of the rear row of tanks, including tanks 102, 104, 106, and 108. The other sides of the front portions 115*a*, 117*a*, 119*a*, and 121*a* and back portions 115*b*, 117*b*, 119*b*, and 121*b* are secured to the outsides of the walkways.

A first walkway 122 spans from the top of stairway 110 to a second walkway 124. Second walkway 124 spans from the end of the first walkway 122 to the end of a third walkway 126. A descending staircase 112 is connected to the outside end of the third walkway 126. The connection points between the stairs and walkways are obscured in FIG. 1A by the cross-access sets 114, 116, 118, and 120, but can be seen in FIGS. 7A and 7B. It should be noted that cross-access sets 114, 116, 118, and 120 are in many instances not necessary depending on the spacing established between the tanks being accessed. In other words, other systems would not include cross-access sets, but be alternatively laterally supported (e.g., directly fixed to the tanks on both, or even one side).

Figure 2A:
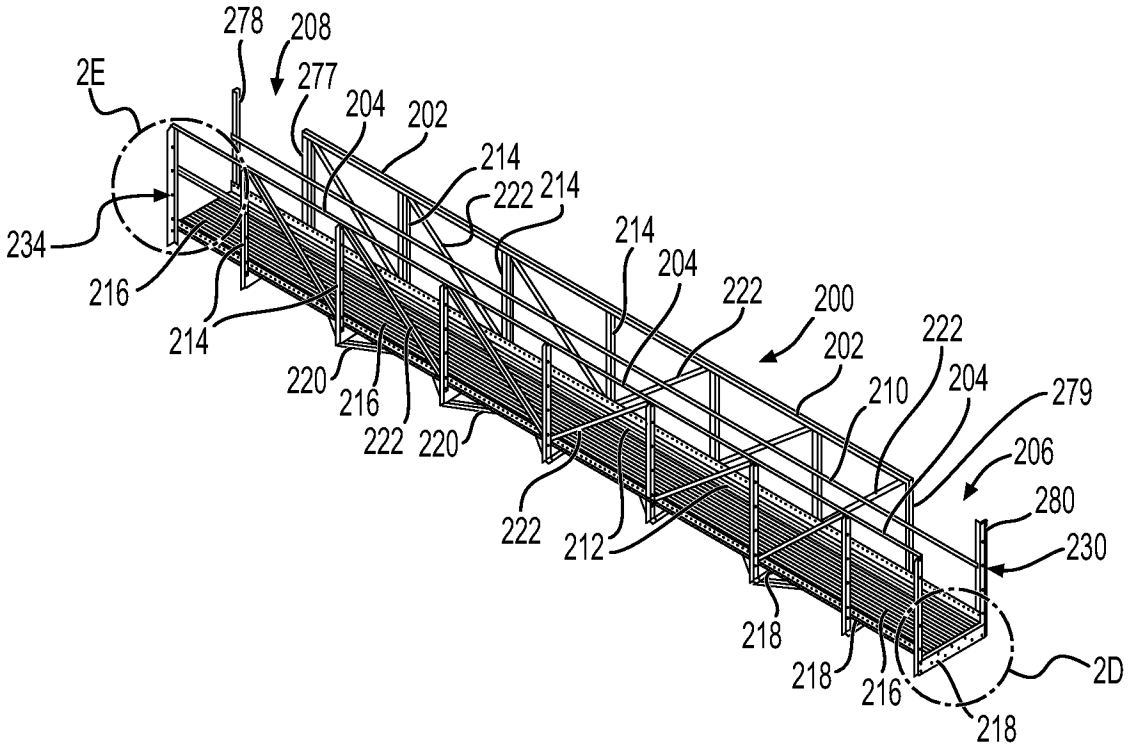
FIG. 2A shows a walkway removed from the overall system of FIG. 1A.

FIG. 2A shows a perspective view of an example walkway unit 200 which could comprise any one of the walkway arrangements 122, 124, or 126 shown in FIG. 1A. Referring to FIG. 2A in more detail, it can be seen that walkway 200 includes a tank-facing top rail 202 and an outer side top rail 204. In the embodiment 200 shown in the figure, gaps 206 and 208 occur on each end of the tank-facing side top rail 202. These optional gaps serve to allow workers to access the tank, but walkways where access is not required will simply complete rails 202 and 204 to the end posts (e.g., posts 278 and 280).

Below the top rails 202 and 204, mid-rails 210 and 212 extend substantially in parallel thereto. The top and mid-rails interconnect a plurality of upright posts 214. The upright posts 214 extend down from the top rails 202 and 204 all the way below a grating 216 (which extends all the way from end to end of the system 200), or alternatively could be configured into segments which combine to complete the walkway.

Figure 2B:
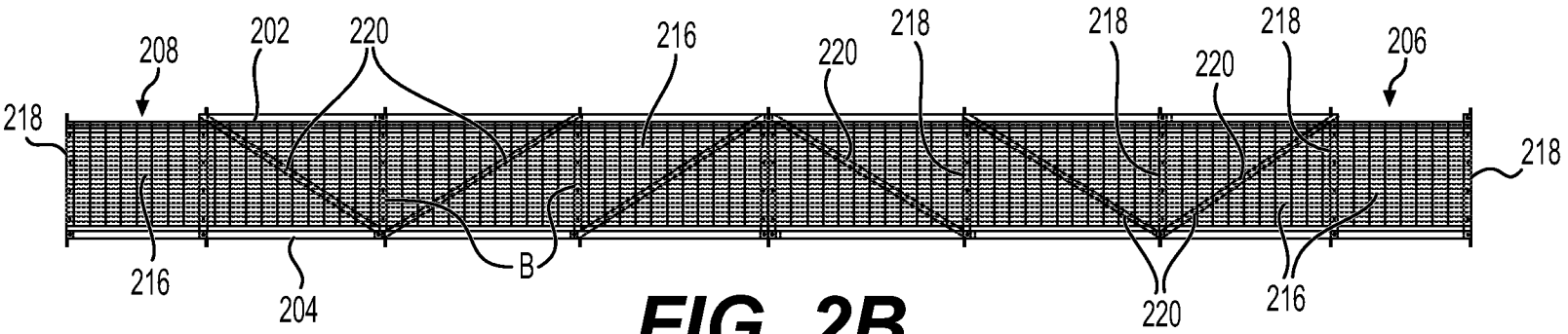
FIG. 2B shows the walkway of FIG. 2A from above.

The grating 216 is supported atop a plurality of transverse grate support members 218. A lower portion of grate support members 218 is used to support a plurality of angled sway truss members 220 (see FIGS. 2B and 2C). FIG. 2B reveals how each member in the group 220 is oriented, the innermost truss members being parallel relative to one another in the same plane, and the outer truss members being reversed/angled in a different direction relative to the inner truss members (see FIG. 2B).

Figure 2C:
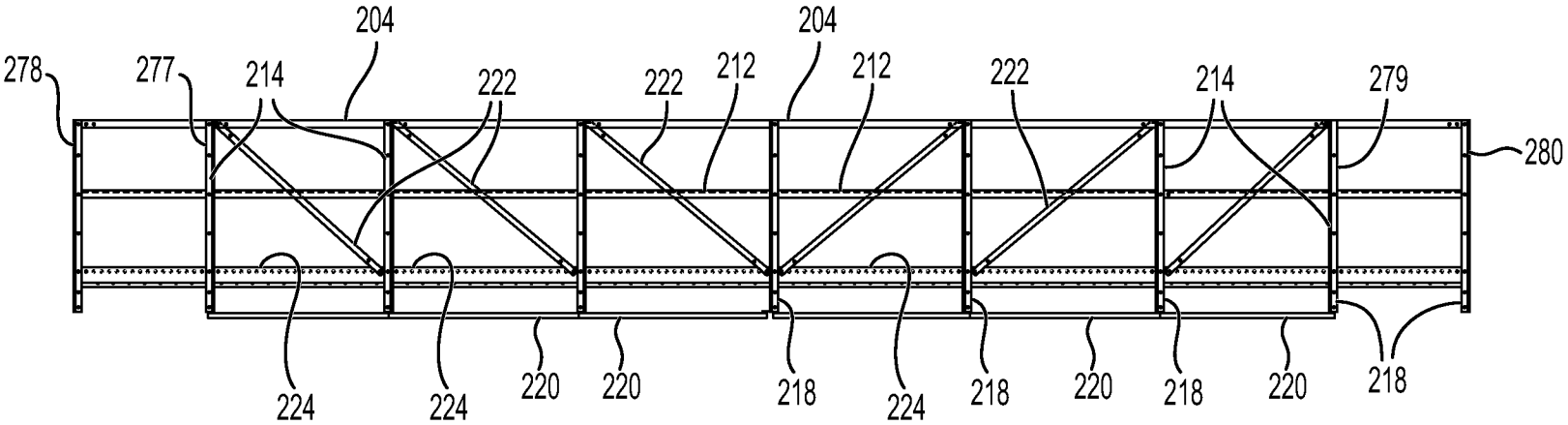
FIG. 2C shows the walkway of FIG. 2A from the side.

Referring to the side view of FIG. 2C, it can be seen that inwardly-inclined angled members 222 (inclined toward the walkway center) are interconnected between the vertical flanges of the upper rails 202/204, and at the bottom of each member 222 are connected into the toe boards 224.

Figure 2E:
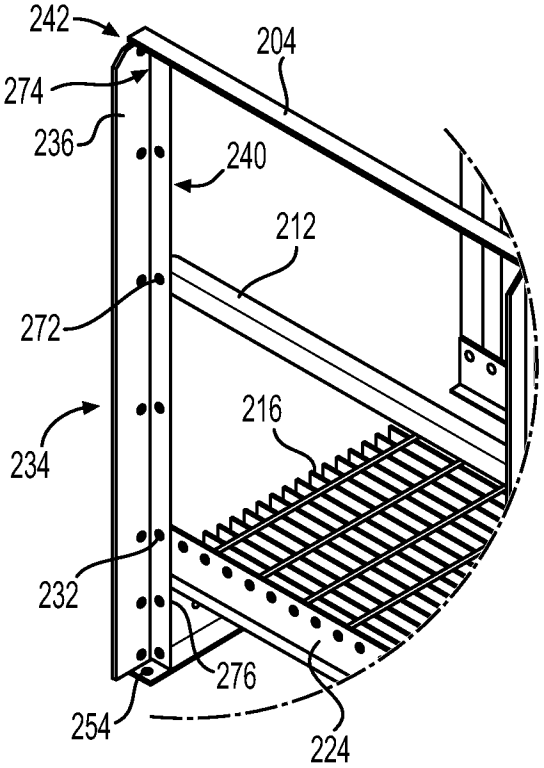
FIG. 2E shows breakout area 2E from FIG. 2A.
Figure 2D:
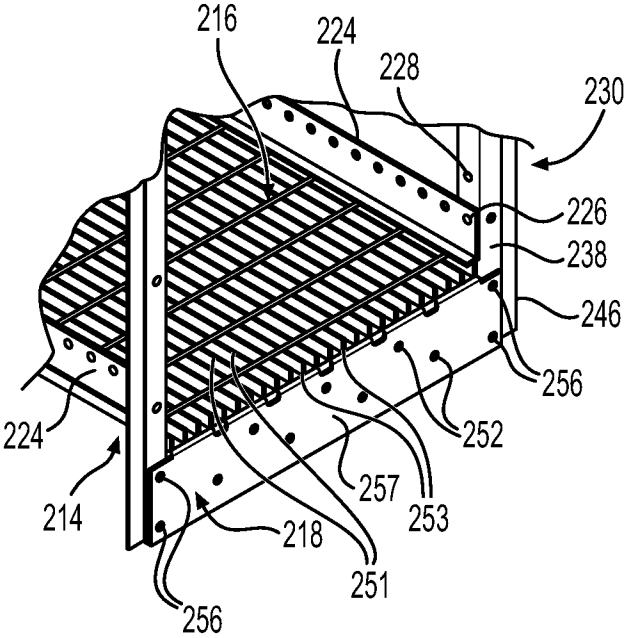
FIG. 2D shows breakout area 2D from FIG. 2A.

FIG. 2D (which is reflected as Detail 2D in FIG. 2A) reveals that opposing toe boards 224 exist on each side of the grate 216, and that these boards 224 are secured using fasters (e.g., bolts) received through an aperture 226 (one side is shown in FIG. 2D) on the end of the toe board into a reciprocating hole 232 made through a longitudinally extending flange of an end post 230 which is one of the plurality of posts 214. The toe board on the opposite side is installed in the same way.

FIG. 2E (which is reflected as Detail 2E in FIG. 2A) shows the other end of the walkway such that a hole 232 can be clearly be seen to be made into an end post 234 (which is one of the plurality of posts 214) for the purpose of securing the toe board 224 on the other side of the walkway. Also in FIG. 2E, it can be seen than an added longitudinal support plate 236 has been fastened onto and is thus made to be substantially parallel with the outwardly-extending flange (not shown, but like outwardly-extending flange 238 exposed in FIG. 2D) of post 234. Added plate 234 provides structural integrity in the plane transverse to the walkway, which is a critical dimension. This leaves a longitudinal flange 240 of the post exposed, and not reinforced since it is not a critical dimension. By only reinforcing the critical dimension, material costs are greatly reduced.

Figure 2F:
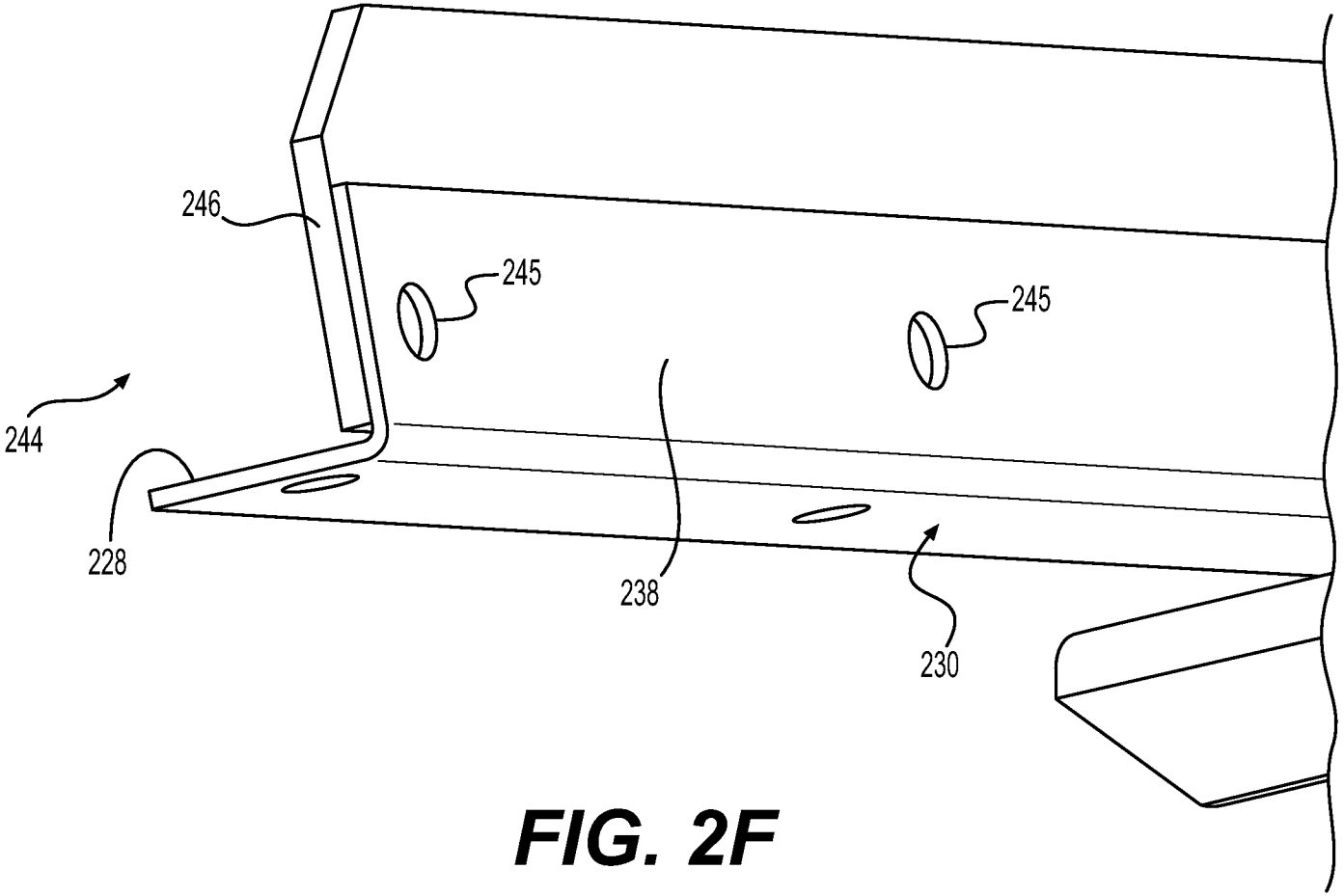
FIG. 2F shows the details of a reinforced member at an end.

FIG. 2F, which illustrates a view of an individual reinforced post before installation, reveals an end 242 (see, e.g., FIG. 2E post 234; FIG. 2F reflects the appearance of post 234 as it would appear before being installed so that end is revealed instead of being obscured by rail 204). As can be seen, a detailed view of an end of the post 244 reveals a reinforcing plate 246 fastened to the laterally-extending, first flange 238, which a plane existing in the critical dimension structurally. The reinforcing plate 246 extends the entire length of the post 230. The longitudinally-extending (second) flange 228 is not reinforced since it is not in a critical dimension structurally. A plurality of longitudinally spaced-apart apertures 245 (see FIG. 2F) are made through both the first flange 238 and the reinforced member 246 at corresponding positions such that fasteners (e.g., bolts, not shown) can be passed through both to complete the connection. In the disclosed embodiment, each of the posts on either side of the walkway in the plurality 214 include a reinforced arrangement disclosed in FIG. 2F. With the walkway, the weakest dimension is lateral. Thus the reinforcing member 236, being in a vertical orientation in the walkway, minimizes stresses for the overall combined member 234 when lateral forces are applied.

Figure 3B:
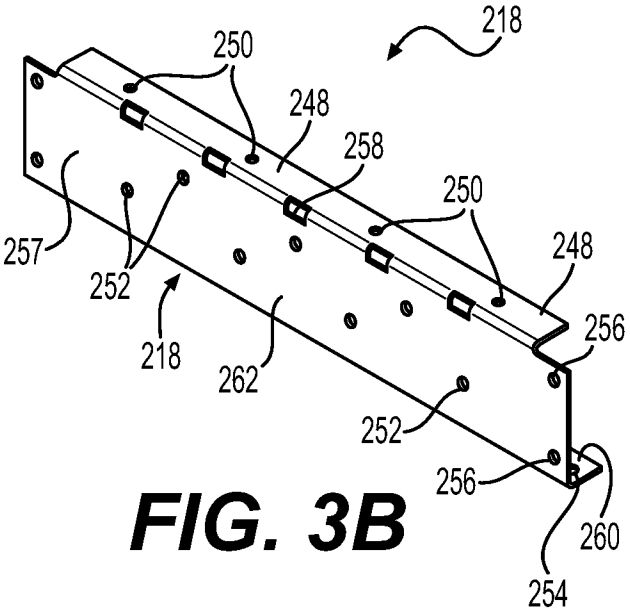
FIGS. 3B-F show respectively, a first perspective, top, front, side and second perspective views of the grate support after it has been processed.
Figure 3C:
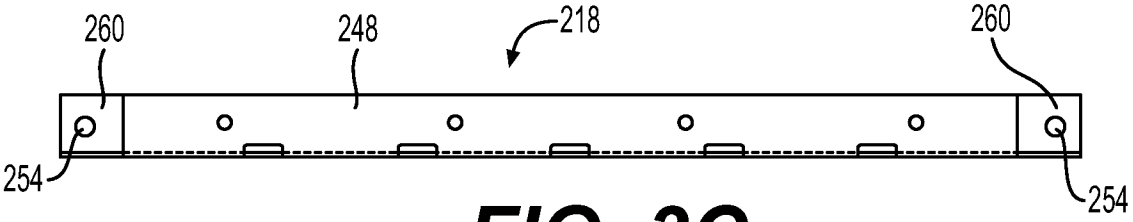
Figure 3A:
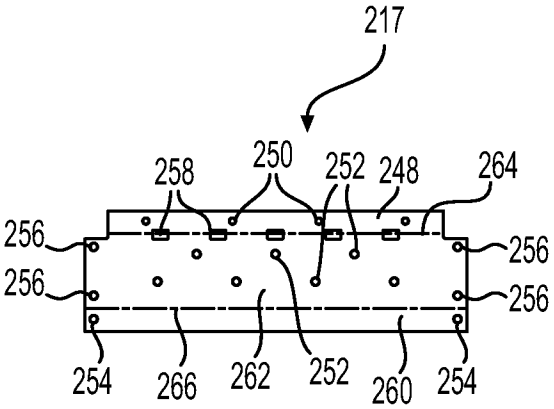
FIG. 3A shows a pre-processed grate support of the embodiment disclosed.
Figure 3D:
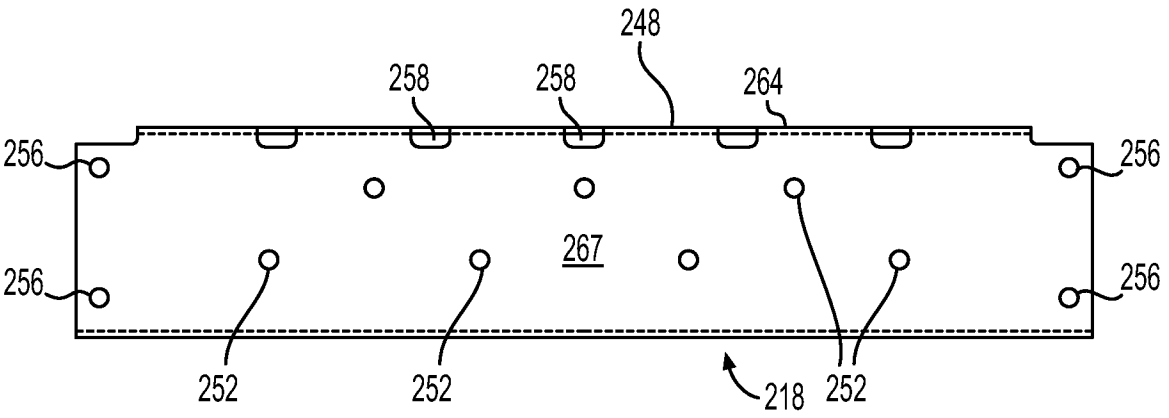
Figure 3F:
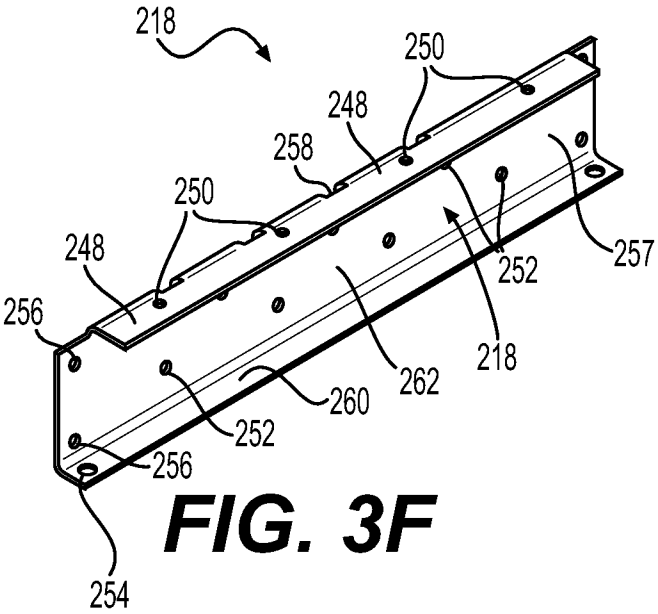

Details regarding the grate support members 218 can be seen in FIGS. 3A-F. FIG. 3A shows the grate support as a pre-punched/cut flat member before it has been bent into an ultimate shape. As can be seen, the pre-folded member 217 shown in FIG. 3A is substantially flat, and includes numerous apertures that have been formed there-through. The margins of the article are folded such that the device becomes the finished grate support member 218 which has the ultimate shape reflected in FIGS. 3B-F. The punching and folding are executed using known technologies.

In the finished article, a first group of apertures 252 exists in a main body portion 262 of the member 218 which are used to connect the grate support to an adjacent structure, e.g., another grate support on an adjacent walkway, an adjacent staircase, etc. Two spaced-apart opposing holes 254 in an outwardly-extending lower margin 260 are used to connect lateral bracing truss members below the grate. More specifically, the bottom margin is bent to comprise an outwardly-extending bottom shelf 260 of the finished grate support 218 (see top view FIG. 3B). Aligned slot apertures 258 are formed along a fold line 264 in the support 218.

Figure 3E:
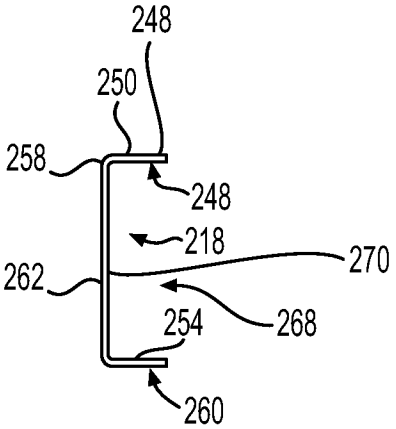

The finally formed article, with top shelf 248 created over fold line 264, and bottom shelf 260 created over lower fold line 266 has the appearance reflected in FIGS. 3B and 3E where shelves 248 and 260 extend perpendicularly out from the top and bottom of the main portion 262 at substantially right angles. This creates a channel area 268 which is defined inside an inside surface 270 of the main portion 262, the underside of shelf 248 and the upper surface of shelf 260.

Figure 4:
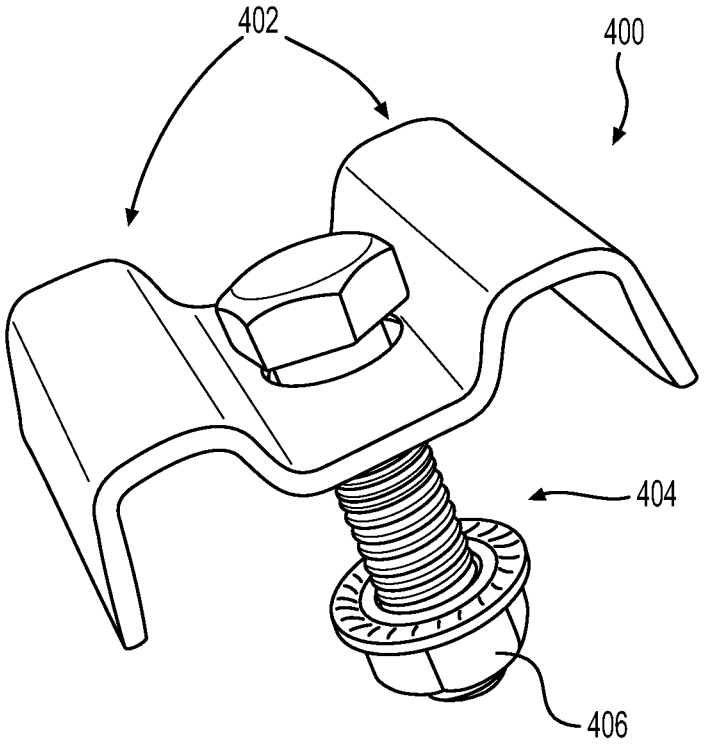
FIG. 4 shows a grate connector used along with the disclosed embodiments in perspective.

Referring to FIG. 3B, the shelf surface 248 will be used to support one end of the grate 216, which is rested atop the shelf surface 248. Thus, the shelf surface 248 supports the end of the grate 216 from below. The shelf surface also includes a plurality of equally spaced-apart aligned apertures 250. Each of the apertures 250 is sized to receive a conventional saddle clip like clip 400 shown in FIG. 4. Looking at FIG. 4 together with FIG. 2D, it can be seen that opposite wings 402 of each saddle clip 400 are received over a plurality of longitudinal members 251 in the grate (see the end shown in FIG. 2D) to clamp down on and secure the ends 253 down onto the shelf 248. The bolts 404 pass through the gaps between the longitudinal members of the grate, then through the holes 250 provided for each grate support along the walkway. Once the tips of the bolts have passed through, they are tightened from the underside using threaded nuts 406 to complete securement of the grate ends atop the shelf surfaces 248 of all of the grate supports installed below the grate.

One grate support (e.g., support 218), in embodiments, will exist at each end of a particular walkway portion (e.g., walkway sections 122, 124, or 126) and at intermediate spaced-apart positions as shown in the figures. In the disclosed embodiment, the channel areas 268 for the grate supports located at the outer ends of the walkway face inward. Thus, at each walkway end, the back surface 257 of the supports 218 is exposed (see, e.g., FIG. 2D). Together, the grate supports support the grate 216 from below at each end.

The holes 252 created through the main portion 256 of each grate support 218 are used to connect the walkway at each end to either another walkway section, or to a set of stairs. The walkway-to-walkway connections are made by bolting through holes 252 in in the grate support of the adjoined walkway. The stairs (e.g., stairs 110 and 112) are connected into the grate supports at a walkway end, but use a different device to do so, as will be discussed hereinafter.

The apertures 256 made into the ends of the main portion 262 are used to bolt on the inwardly turned angled posts 230 as can be seen in FIG. 2D.

The apertures 254, after the posts, e.g., posts 234, 230, 278, and 280 are installed, remain exposed inside the V-insides of each post as can be seen in FIG. 2E. The post shown in FIG. 2E, since it is for a post at the end of the walkway, will remain exposed. But the similar holes 254 existing at intermediate locations are used to connect lateral bracing members (e.g., struts) 220 at each end (see FIG. 2C). These lateral bracing struts 220, which are connected to the bottom shelf 260 of each grate support 218, zigzag in parallel beneath the grate 216 to form a truss arrangement that prevents sway towards the middle areas of the walkway.

The mid-rails 210 and 212, in embodiments, are roll formed into an angle (e.g., angle iron). Alternatively, however, premanufactured structural or other sorts of materials could be used to comprise the mid-rails or other components mentioned herein. The inside portion of each mid-rail angle extends down, and the upper part of the angle extends inward (see, e.g., the end of mid rail 212 shown in FIG. 2E). The mid-rails extend longitudinally all the way from the post at one end to end of the walkway (see FIG. 2A) to the post at the other end. They are connected to each post 214, including end posts 278 and 280, using apertures 272 provided in the inner flange of each post 214 (see FIG. 2E).

The top rails 202 and 204 are also roll formed into an angle. Again here, however, numerous other processes for creating or supplying these components could be utilized. Rail 202 extends all the way between two posts 277 and 279, but stops short of end posts 278 and 280. In doing so, open top areas 206 and 208 are created where no rail exists. Both top rails 202 and 204 are oriented atop the posts such that the angle extends down inside the post, and then outwardly over the top of the post (see FIG. 2E). The top rails are fixed to the post tops by installing bolts through holes in the flanges of the posts and through reciprocating holes formed in the downwardly-extending flange of each top rail.

A related system is used to comprise stairs (e.g., stairs 110 and 112) which extend down from the outermost walkway members 122 and 126, respectively. These details can best be seen in FIGS. 5A-E. Stairway 110 is used as an example of how both staircases are configured.

Stairway system 110 includes hand rails 502, mid-rails 504, steps 506, a first (upper) stair frame member 508, a lower second stair frame member 510, a transition plate 512, vertical truss web members 514, and reinforced horizontal truss web members 516.

Figure 5A:
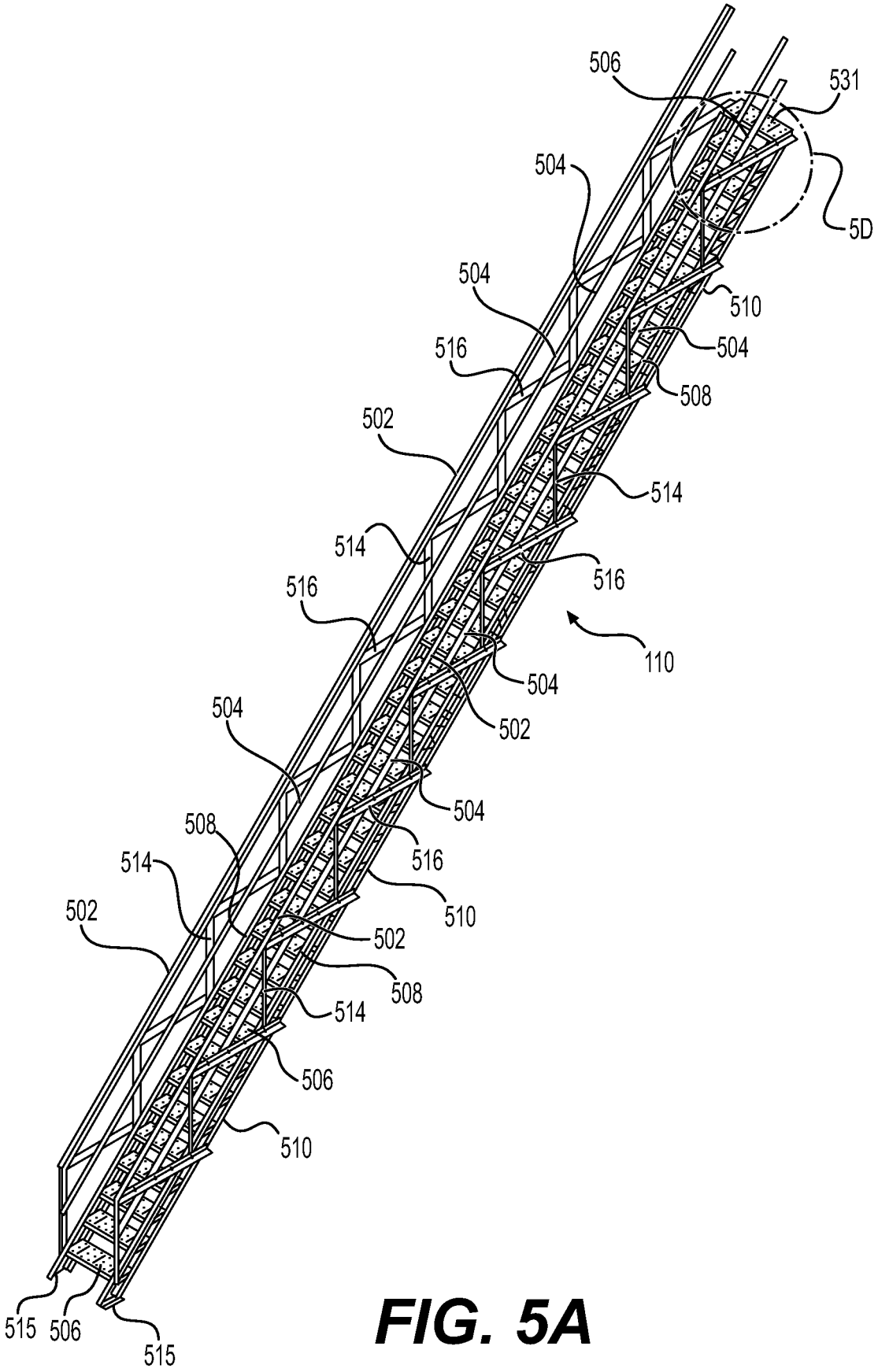
FIG. 5A shows a perspective view of the stairs removed from the FIG. 1A embodiment.
Figure 5B:
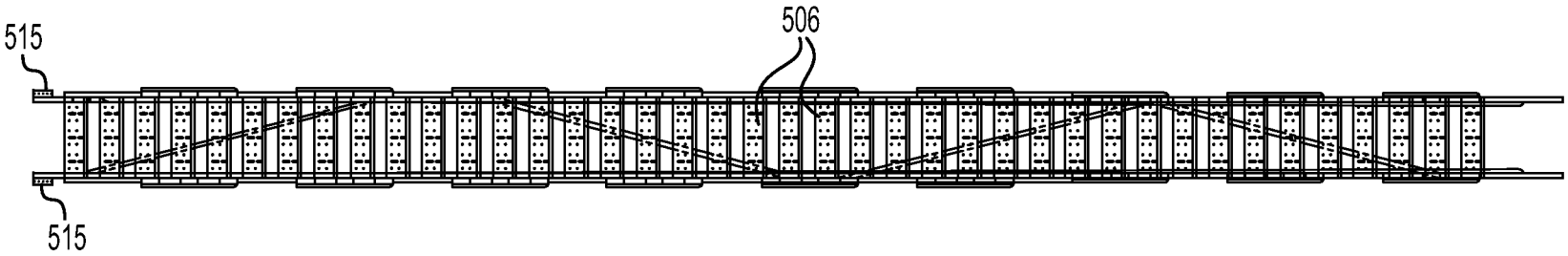
FIG. 5B shows the stairs of FIG. 5A from above.
Figure 5C:
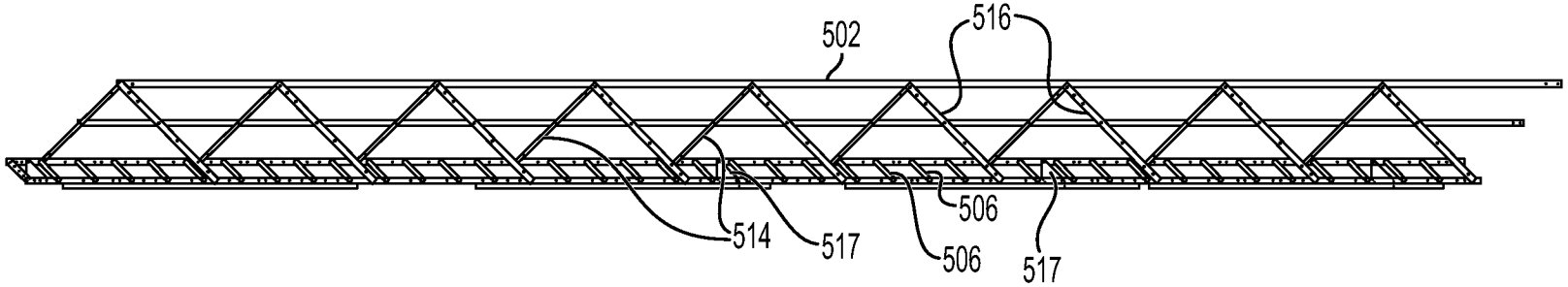
FIG. 5C shows the stairs of FIG. 5A from the side.
Figure 5D:
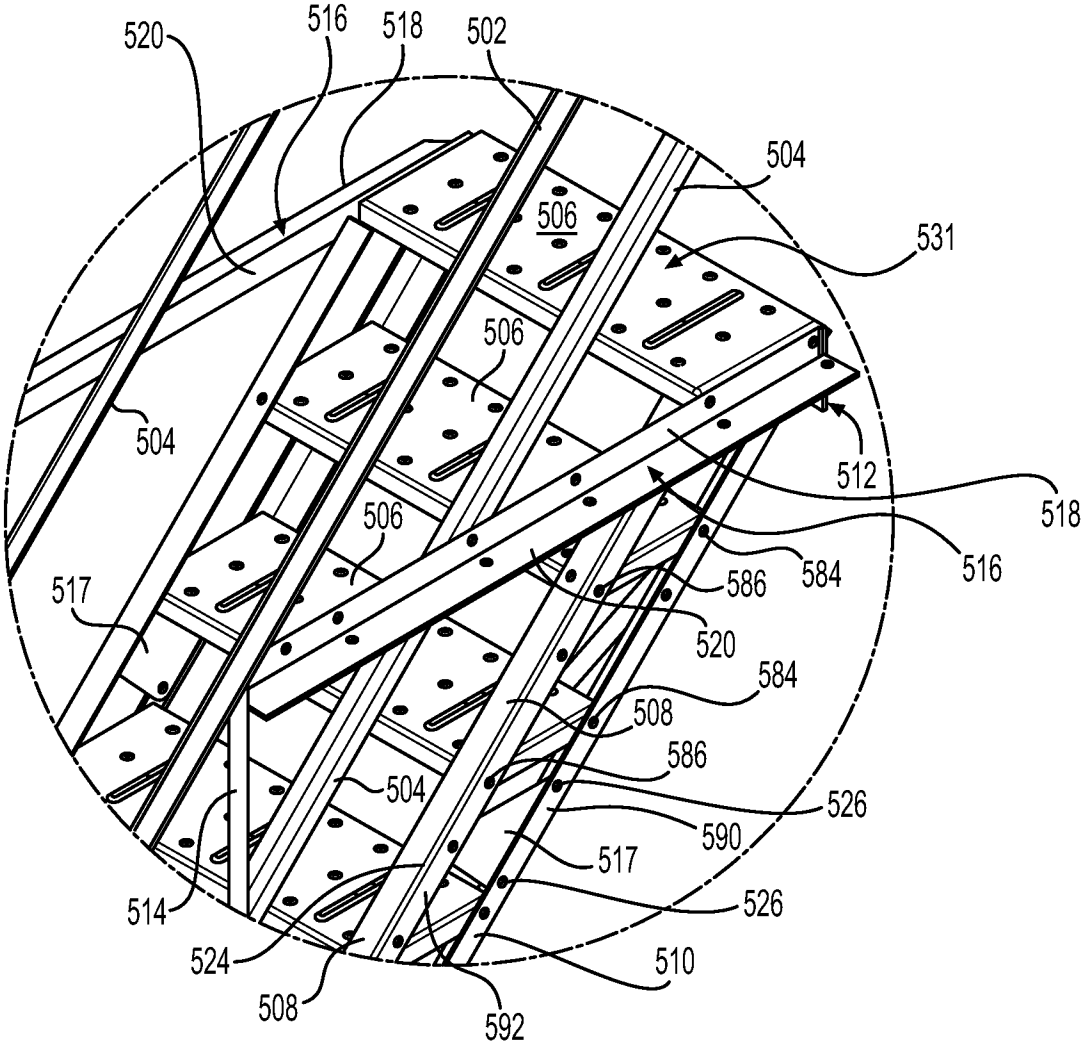
FIG. 5D shows highlighted breakout 5D shown in FIG. 5A.
Figure 5E:
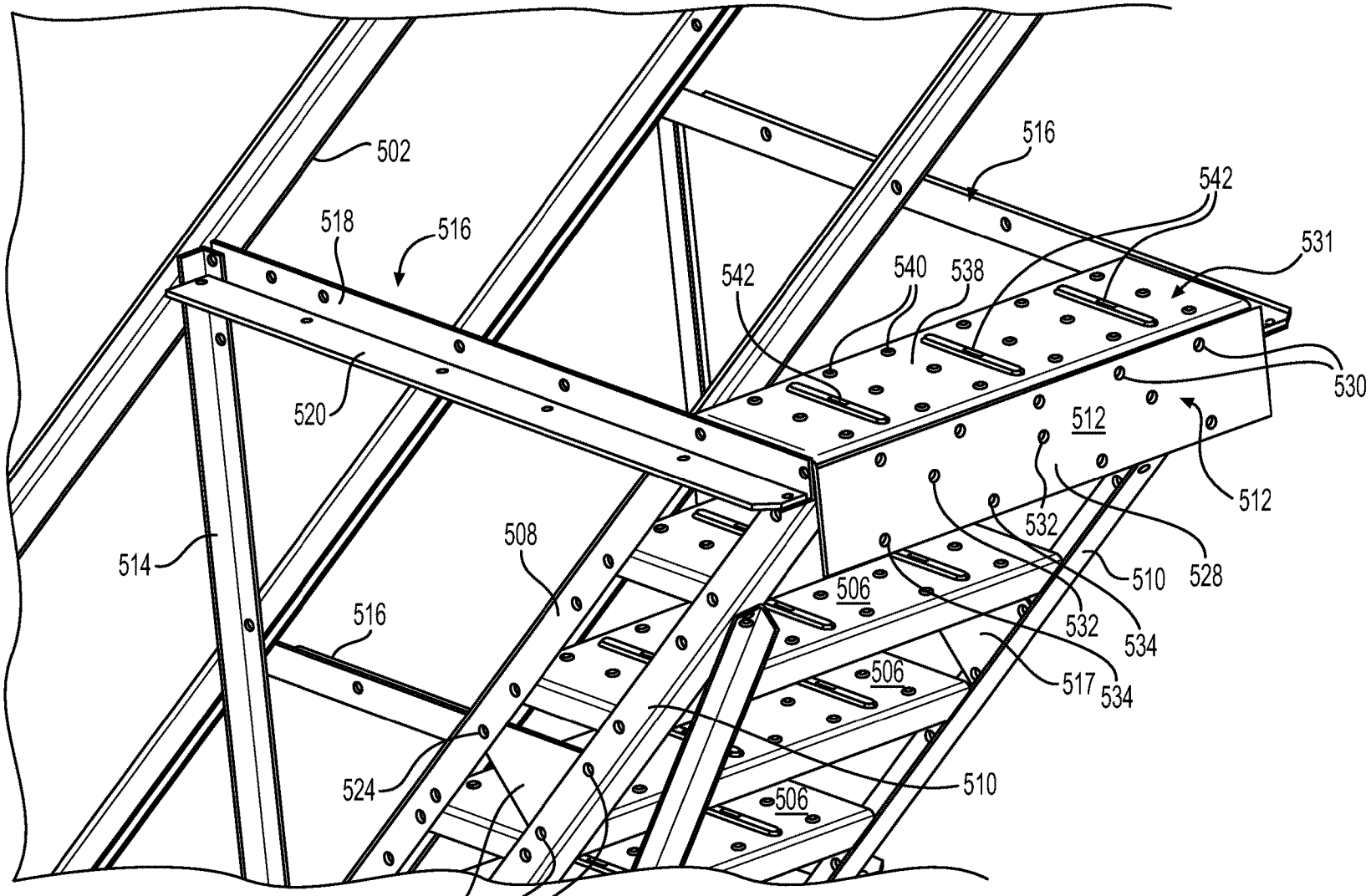
FIG. 5E shows the top of the stairs removed from/not yet connected to the walkway.

The first and second stair frame members 508 and 510 are reinforced by triangular spacers 517 which are secured between sequential steps 506 (see details in FIGS. 5D and 5E). The triangular spacers 517 each include single fastening locations 524 made into the vertical flange of the upper stair frame member 508 and a pair of spread apart fastener locations 526 both occur at different positions along the second lower stair frame member 510.

The steps 506, in side view, are fastened between and angled relative to the upper and lower frame members 508 and 510 as shown such that they are horizontal relative to the ground when erected upon installation (thus substantially parallel to the reinforced members 516). This puts the reinforced flange 520 in the dimension parallel to the steps, which provides critical support, while cooperating with the lower truss against the lateral loads on the stair guardrails. Additionally, whereas the omission of reinforcement of the flange 518 avoids material waste by avoiding the creation of a standard sized angle iron which is made larger to handle the structural requirements. The process here employs the addition of metal only in the dimension in which it is needed. The details regarding each of the reinforced horizontal truss web members 516, including the angle member flange 518, and reinforced member 520 flange is substantially the same as the arrangement shown in FIG. 2F. The addition of the horizontally extending reinforcing members 520, like with the reinforcing members on the walkway, minimize the stresses for the overall combined member 516 when supporting weight on the steps 506.

The stair arrangement 110 is supported from below on feet 515 located at the base of the stairs. The feet 515 can be seen in FIGS. 5A and 5B.

Figure 6B:
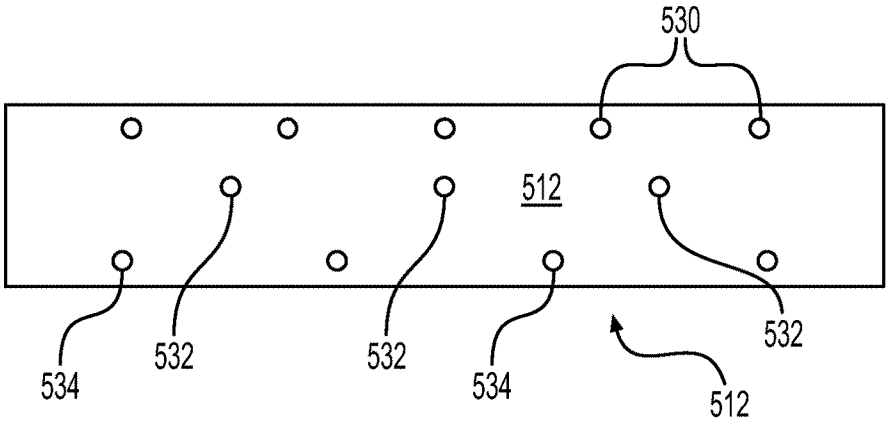
FIGS. 6A-D show the transition plate used to secure the stairs to the walkway in perspective, front, and two side views.
Figure 6A:
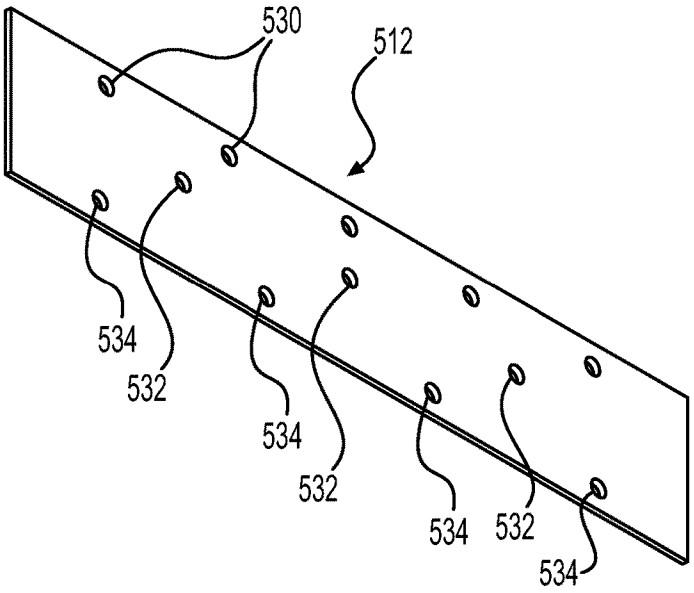
Figure 6C:
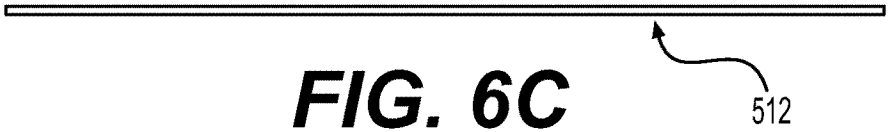
Figure 6D:
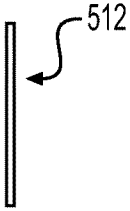

FIGS. 6A-D show the details regarding the transitional member 512 used to fasten the top of the stairs to whatever it is fastened to, e.g., an adjoining walkway end, or in other embodiments, some other adjacent structure. Referring to FIG. 6A, a top row of five holes 530 are used to receive bolts used to fasten the plate top to the top step 531 as shown in FIG. 5E. A middle row of three holes 532 as well as the lower row of holes 534 are used to connect the transitional member 512 into the reciprocating holes on a grate support 218 at the end of an adjoining walkway. Referring to FIG. 5E, an abutment surface 528 is, when connected to a walkway end, put against an opposing outer surface 257 (see FIG. 2D). Holes 532 and 534 in the transition plate 512 are configured to match up with the holes 252 of the grate support 218. Mutual hole alignment enables the stairs to be secured (using bolts inserted through the aligned holes) to the end of an adjacent walkway. In some views, this connection is obscured by the cross-access arrangements 114, 116, 118, and 120 (e.g., in FIG. 1A). But the interface, after a connection is made, can be seen in FIGS. 7A-B (from an overhead perspective, and from below, respectively).

Figure 8B:
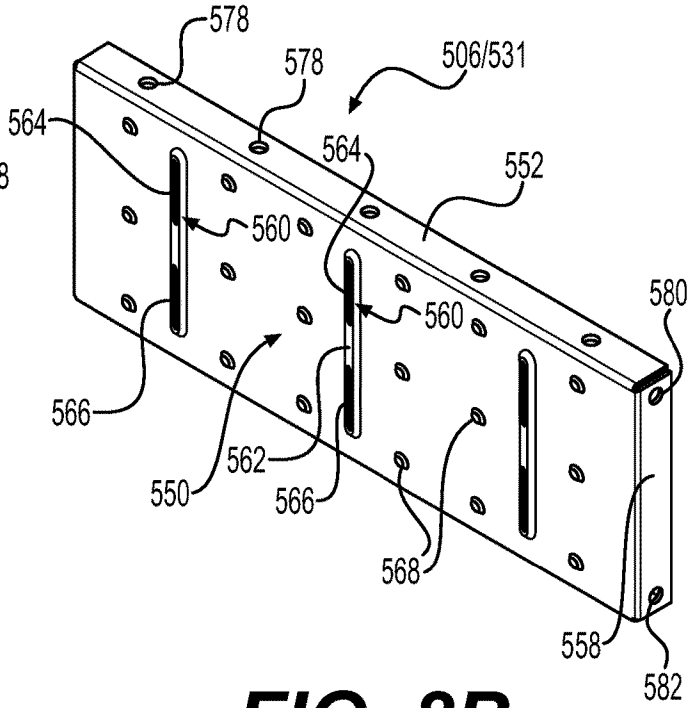
FIGS. 8B-F show the step in perspective, from a first side, above, a first side, and a section 7F taken out of FIG. 8D.
Figure 8A:
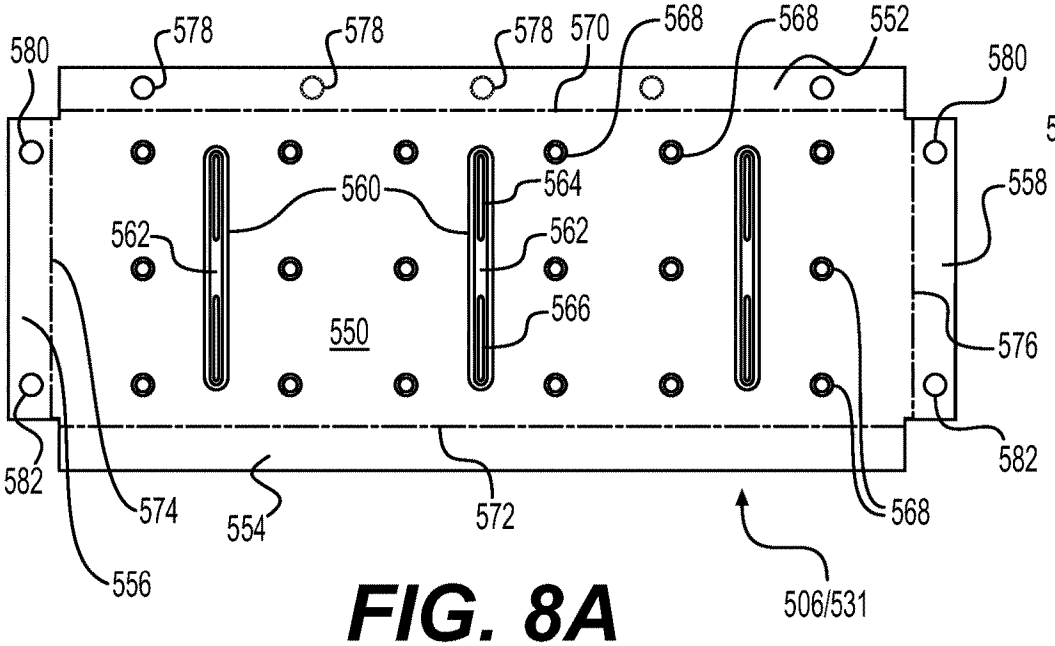
FIG. 8A shows a step from the stairs before processing.
Figure 8C:
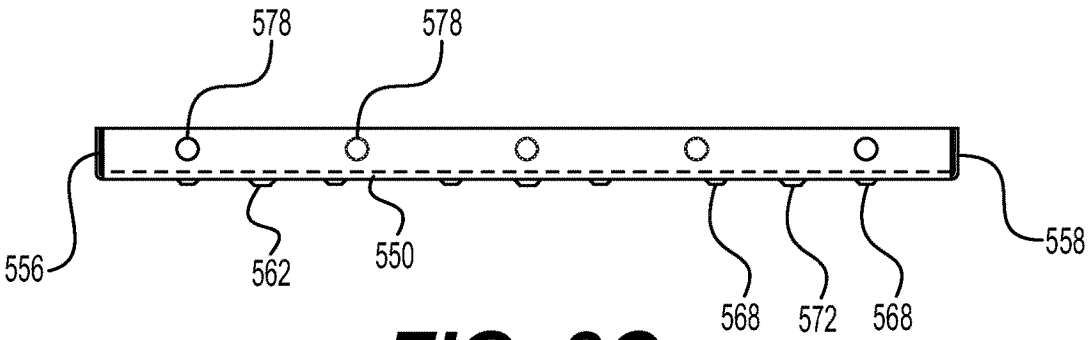
Figure 8D:
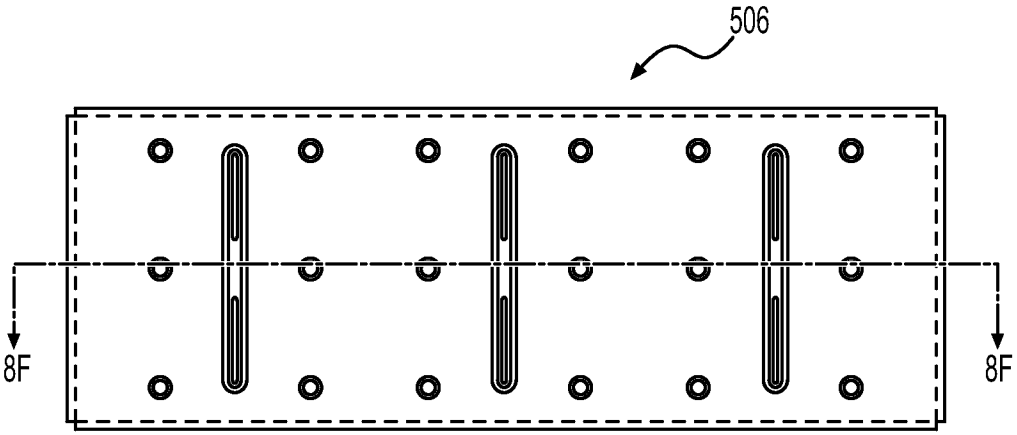
Figure 8F:
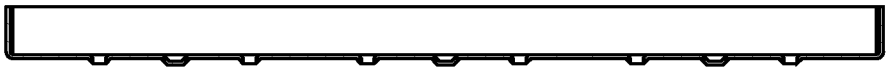
Figure 8E:
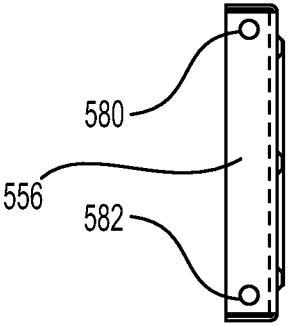

The top step 531 is incorporated into the stair-to-walkway connection interface. An example of top step 531 is shown in FIGS. 8A-F. Referring first to FIG. 8A, a pre-fold step is shown. The step 531 in the plurality of steps 506 has an upper margin 552, a lower margin 554, and side margins 556 and 558. The ultimate article shown in FIGS. 8B-F is created from the pre-processed article of FIG. 8A by folding margin 552 on fold line 570, margin 554 over fold line 572, margin 556 over fold line 574, and margin 558 over fold line 576. With respect to the rest of the steps included in the plurality of steps 506, it is possible for all of the remaining steps other than top step 531, they could be formed without the connecting apertures 578 since flange 552 will not be attached to an adjacent structure. It is also possible, however, that all the steps in the plurality 506 would have these holes to reduce the need to include different parts in construction. Additionally, in yet other embodiments, the flange 552 for only top step 531 could be enlarged in the vertical dimension to accommodate additional structural integrity required in connecting to the adjacent structure (e.g., stairway connection plate 512).

Each step 506 includes three corrugations 560 having upper and lower slots 564 and 566 defined on either side of a melded-together portion 562. It should be noted than in an alternative embodiment, the melded-together portion has been removed, and one single slot extending to the extremes for each of the slot pairs 564-566 are the ends of each single slot (not shown). It should be noted that each corrugation 560 reinforces each step in a direction horizontal in the direction to which the stairs are extending. Because these ribs/corrugations run transverse to the length of each step, they assist in providing support in a critical dimension when subjected to downward forces (e.g., due to workers on the stairs, etc.). A plurality of truncated hollow raised protuberances 568 are formed such that they form raised apertures in the top surface 550 of each step 506. This helps with grip and provides water dissipation away from the raised protruding portions.

The hole set 578 is optional in all of the steps 506 except for the top step 531. They are needed in top step 531, however, since it is involved in the attachment to the adjacent walkway end. Holes 580 and holes 582 produced into each of the downwardly-folded end walls 556 and 558 are used to secure the opposite sides of each step 506 into the staircase. More specifically, holes 580 produced into the end walls at the side of each step can be matched up with corresponding holes 584 (see FIG. 5D) produced into a flange 590 in the lower frame member 510 to receive a bolt (not shown) to complete the connection. A second set of holes 582 are formed into the front sides of end walls 556 and 558. These holes 582 can be aligned with holes 586 defined through a flange 592 of the lower step frame member 510 to receive a bolt (not shown) to complete the connection.

Figure 7A:
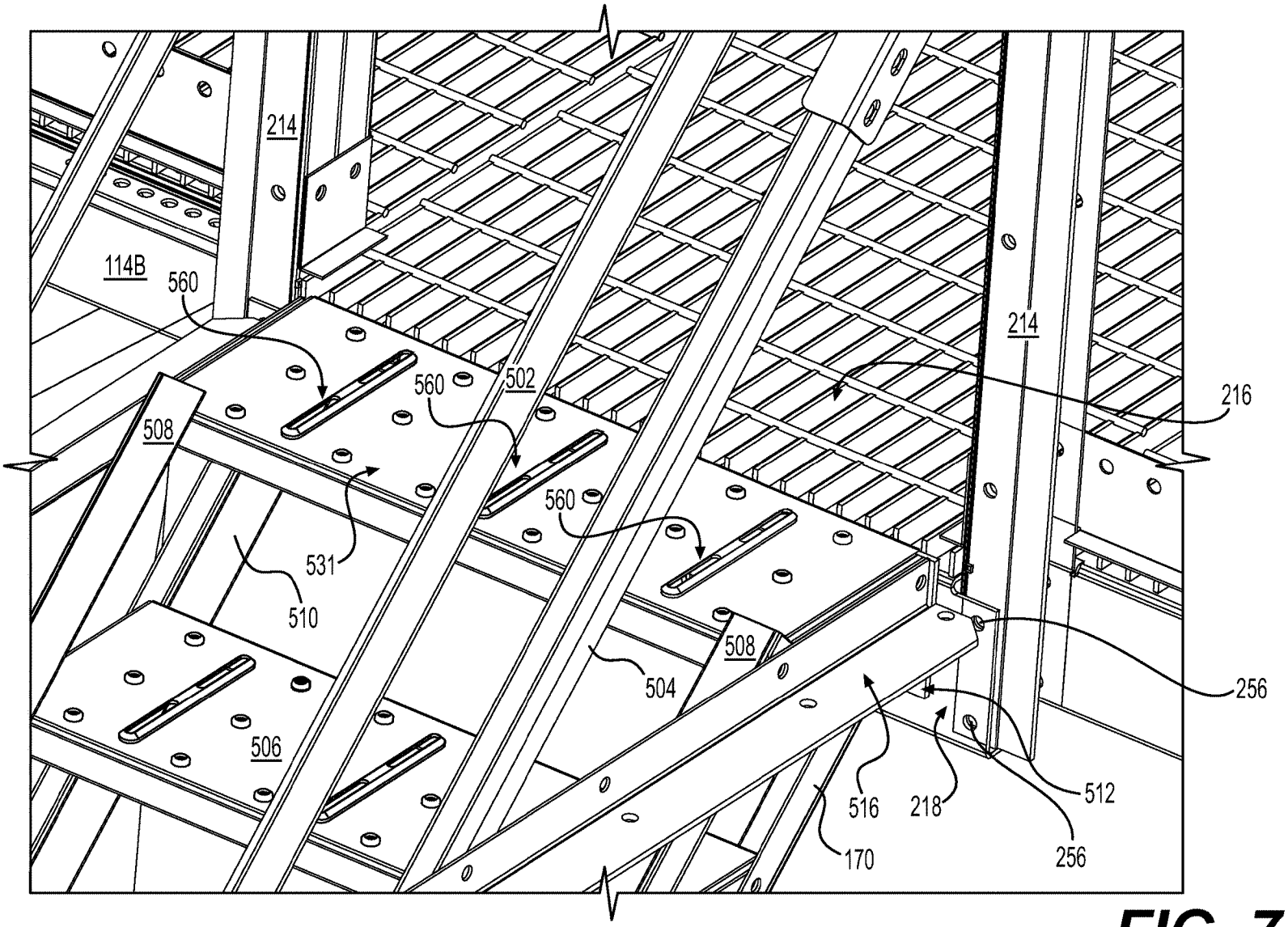
FIG. 7A shows the interface between the top of the stairs and a walkway from above.
Figure 7B:
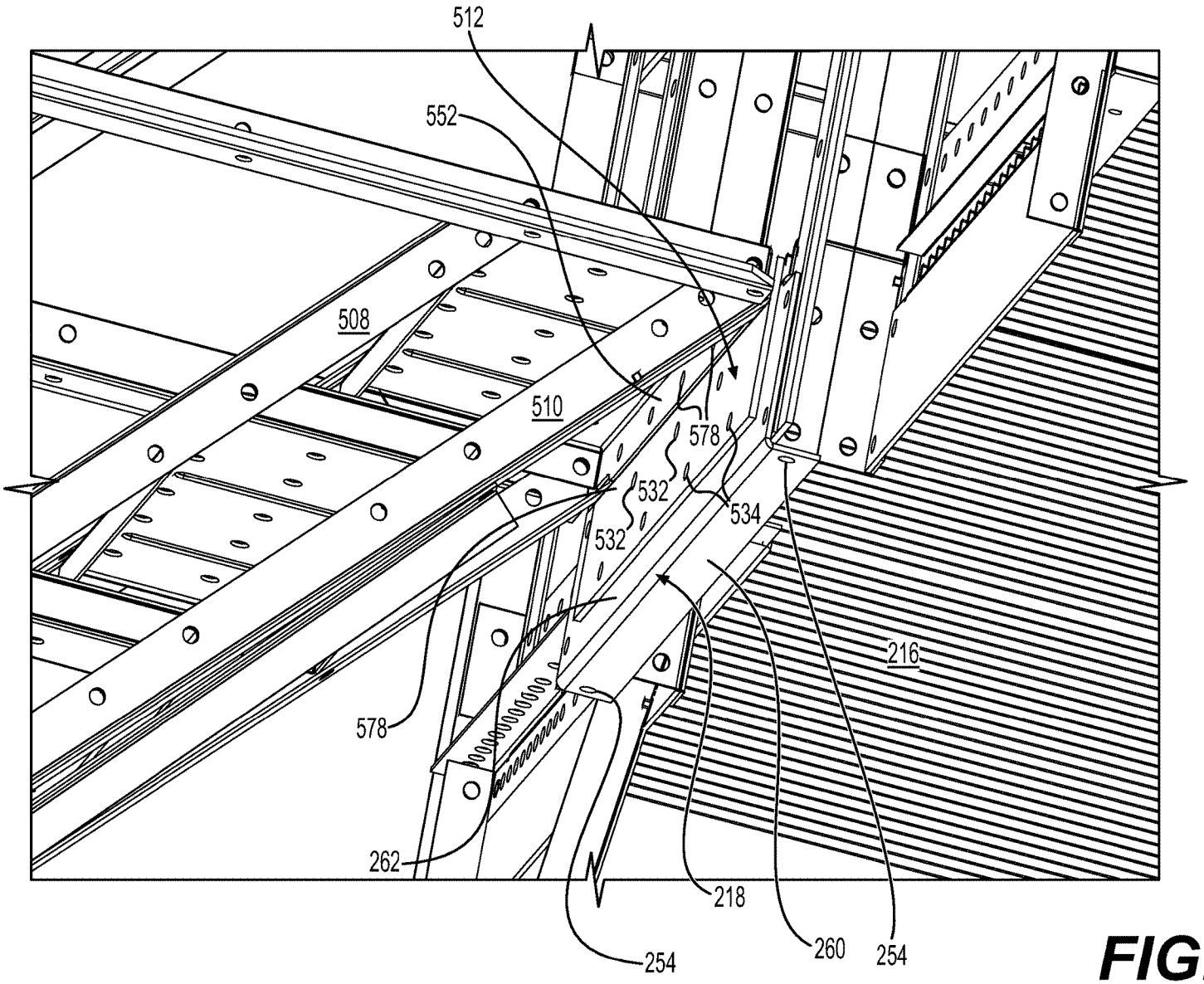
FIG. 7B shows the interface between the top of the stairs and a walkway from below.

Referring back to the stair-walkway interface perspectives illustrated in FIGS. 7A-B, it can be seen how the outermost grate support 218 of the walkway, the transition member 512 of the stairs, and the top step 531 all come together to make a connection. More specifically, holes 578 in the top step 531 are aligned with holes 530 in the transition plate and bolts are received to connect the two components together. Then, the hole sets 532 and 534 on the transition plate are aligned with the holes 252 in the body 262 of the grate support, and bolts (not shown) are received therethrough to make the connection. This completes the connection of the stairs to the walkway.

While the present disclosure has shown and described exemplary embodiments, it will be understood by those of ordinary skill in the art that various changes in form and details may be made therein without departing from the spirit and scope of the present disclosure, as defined by the following claims.

The invention claimed is:

1. A system for supporting a walkway, the system comprising:

a raised elongated walkway platform having a first end and a second end and a length;

the platform supported from below at the first end of the platform by a first outwardly-extending upper shelf presented from a top portion of a first supporting member and at a second location underneath the platform by a second upper shelf presented by a top portion of a second supporting member, the platform being supported by the first and second outwardly-extending upper shelves and thus positioning an upper surface of the platform to be level with at least one walking surface on an adjacent structure;

each of the first and second supporting members having bottom portions presenting outwardly-extending lower shelves, each of the lower shelves supporting a truss arrangement which is spaced apart from and supported underneath the platform, the truss arrangement configured to create stability in a horizontal dimension against sway, each of the first and second supporting members oriented to be crosswise with respect to the length of the elongated walkway platform; and a plurality of spaced-apart posts lining laterally-opposing sides of the platform, each post supporting a top rail, and being received through openings at corner edges of the upper shelf and resting on the lower shelves of the first and second platform supporting members.

2. The system of claim 1 comprising:

at least one intermediate platform supporting member located underneath the platform and at a location between the first and second platform supporting members, the second platform supporting member being located at the second end of the platform.

3. The system of claim 2 wherein the intermediate platform supporting member is substantially identical to the first and second platform supporting members.

4. The system of claim 2 wherein:

the at least one intermediate platform supporting member is one of a plurality of intermediate platform supporting members, each intermediate platform supporting member in the plurality working together to support a span of the platform; and the truss arrangement located underneath the platform comprised of a plurality of strut bars, each strut bar being angled in a substantially horizontal plane from a fixation point on a lower outwardly-extending shelf portion of each intermediate platform supporting member, and angling to a fixation point on an opposite side of an adjacent intermediate member.

5. The system of claim 4 wherein the plurality of strut bars zig-zag between the plurality of intermediate platform supporting members.

6. The system of claim 1 wherein the platform is a grating having a plurality of longitudinally-extending parallel bars, and a plurality of longitudinally-spaced cross supports, the cross supports connecting the parallel bars.

7. The system of claim 6 wherein openings existing in the grating between the parallel bars and cross members receive fasteners which are also received through corresponding apertures formed in the top shelf, the fasteners used to clamp down saddle members onto the parallel bars to secure each of the first and second platform ends atop the upper shelves of each of the first and second platform supporting members.

8. A system for supporting a longitudinally-extending platform, the system comprising:

a support member configured to transversely support the longitudinally-extending platform, the support member comprising (i) a mounting portion configured to mount the longitudinally-extending platform to an adjacent structure; (ii) an upper shelf, extending outwardly from above the mounting portion, the upper shelf being configured to secure the platform to the support member and support the platform member from below such that an upper surface of the platform member is substantially level with a walking surface existing on the adjacent structure; and (iii) a lower shelf extending outwardly from below the mounting portion near a bottom of the support member, the lower shelf being configured to support a sway truss arrangement which is spaced apart below the platform, and exists in a horizontal plane underneath the platform which is substantially parallel with the platform;

platform;

the support member being configured to support an end of the longitudinally-extending platform in a transverse direction relative to a length of the longitudinally-extending platform;

one or more post-receiving openings defined through the upper shelf, the one or more openings being configured to receive one or more posts;

the lower shelf being configured to support the one or more posts; and the one or more post-receiving openings and the lower shelf together being configured to support the one or more posts on opposing lateral sides of the walkway.

9. The member of claim 8 wherein the mounting portion is substantially flat.

10. The member of claim 9 wherein the substantially flat mounting portion has mounting holes formed therethrough to receive fasteners to secure a back of the support member to the adjacent structure.

11. The member of claim 8 wherein a plurality of holes are formed through the upper shelf, each hole in the plurality being configured to receive a bolt which also passes through the one end of the platform.

12. The member of claim 11 wherein the platform is a grate, and the plurality of holes in the upper shelf are each aligned with a specific gap in the grate, thus securing the one end of the platform.

13. The member of claim 8 wherein the lower shelf of the member includes at least one hole configured to receive a bolt which passes through an aperture on a connecting end of a truss member in the sway truss arrangement.

14. The member of claim 9 wherein the lower shelf includes a first hole spaced apart from a second hole, the first hole configured to receive a bolt which passes through an end of a first optional angled truss member, the second hole being alternatively useable to secure the lower shelf to an alternative second optional truss member which is, when installed, at an angle different than the angle relative to the supporting member.

15. A walkway system comprising:

a grating supported on a plurality of supports, each support being oriented transversely relative to a length of a longitudinal dimension of the grating, each support including upper and lower shelves, each support and being configured to support the grating from below, the lower shelves being configured to support a truss arrangement in a plane spaced below the grating, the plane being substantially parallel with the grating;

one or more railings each supported on a plurality of posts secured into the plurality of supports each of the plurality of posts being received through openings formed through each of the upper shelves; and each of the plurality of posts resting on the lower shelves of the plurality of supports.

16. A walkway system comprising:

a raised elongated walkway platform having a first end and a second end, the raised elongated walkway platform being supported from below at the first end by a first upper shelf extending out from a first supporting member supported from below by the second end by a second upper shelf extending out from a second supporting member;

the first and second upper shelves including openings therethrough, the openings configured to receive a lower end of each of a plurality of railing posts;

a first and a second lower shelf on each of the first and second supporting members, the first and second lower shelves cooperating to both: (i) support a suspended truss arrangement below the raised elongated walkway, and (ii) support the lower ends of each of the plurality of railing posts received through the openings.

* * * * *